US007435115B2

(12) United States Patent
Kiryu et al.

(10) Patent No.: US 7,435,115 B2
(45) Date of Patent: Oct. 14, 2008

(54) CARD CONNECTOR WITH A SLIDER BRAKING UNIT

(75) Inventors: Koichi Kiryu, Shimotakai-gun (JP); Toshihiro Kusagaya, Shinagawa (JP); Hideo Miyazawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/822,550

(22) Filed: Jul. 6, 2007

(65) Prior Publication Data

US 2008/0182441 A1 Jul. 31, 2008

(30) Foreign Application Priority Data

Jan. 25, 2007 (JP) ..... 2007-015039

(51) Int. Cl.
*H01R 13/62* (2006.01)

(52) U.S. Cl. ..... 439/159; 439/630

(58) Field of Classification Search ..... 439/159, 439/630, 155

See application file for complete search history.

(56) References Cited

U.S. PATENT DOCUMENTS 6,537,090 B2 * 3/2003 Ozawa ..... 439/159
7,011,533 B2 * 3/2006 Miyamoto ..... 439/95
7,108,557 B2 * 9/2006 Kikuchi et al. ..... 439/630
7,198,498 B2 * 4/2007 Miyamoto ..... 439/159
7,309,245 B2 * 12/2007 Sadatoku ..... 439/159
7,314,380 B2 * 1/2008 Kodera et al. ..... 439/159

FOREIGN PATENT DOCUMENTS

JP 2005-268089 9/2005
JP 2006-140068 6/2006

* cited by examiner

*Primary Examiner*—Hae Moon Hyeon
(74) *Attorney, Agent, or Firm*—Staas & Halsey LLP

(57) ABSTRACT

A disclosed card connector includes a housing main unit including a card insertion slot through which a card is inserted into the housing main unit in a predetermined direction; a slider attached to the housing main unit in such a manner as to be slidable along the predetermined direction, wherein the card inserted into the housing main unit is ejected by moving together with the slider as a spring force moves the slider from a position away from the card insertion slot toward the card insertion slot; and a slider braking unit configured to apply a braking force to the slider in such a manner that the braking force increases as the slider moves toward the card insertion slot.

8 Claims, 11 Drawing Sheets

CARD CONNECTOR WITH A SLIDER BRAKING UNIT

CROSS-REFERENCE TO RELATED APPLICATIONS

The present application is based on Japanese Priority Patent Application No. 2007-015039, filed on Jan. 25, 2007, the entire contents of which are hereby incorporated by reference.

BACKGROUND OF THE INVENTION

1. Field of the Invention

The present invention relates to card connectors, and more particularly to a card connector built into a mobile phone, etc., used for inserting a memory card.

2. Description of the Related Art

Memory cards with built-in semiconductor memories are used as information storage media in digital cameras, portable audio equipment, mobile phones, etc. Recently, memory cards that are smaller than regular memory cards have become available, and memory card connectors for inserting such compact memory cards are also available.

Such compact memory cards have been developed to support expanding functions of mobile phones. Accordingly, mobile phones are increasingly provided with built-in compact memory card connectors.

Mobile phones are used in various circumstances. For example, they are carried by users, operated by being unfolded, and placed over data reading devices. Thus, compact memory cards are inserted in and ejected from compact memory card connectors in various circumstances. Furthermore, compact memory cards are small, with each side being only approximately 10 mm, and may thus be difficult to handle for some users. For this reason, compact memory card connectors need to be elaborately designed in consideration of various aspects, compared to conventional memory card connectors.

A compact memory card connector is typically provided with a slider energized by a spring mechanism. This slider is configured to elastically engage with a recessed portion on the side of a compact memory card. In order to eject the compact memory card, the user temporarily pushes the card in with his fingertips and then releases his fingertips. As a result, the lock of the slider is released and is moved by the spring force, the memory card moves together with the slider, and part of the memory card protrudes from the insertion slot of the card connector. Then, the user pinches the part of the memory card protruding from the insertion slot with his fingertips and pulls it out. Accordingly, the elastic engagement between the memory card and the slider is released, and the card is withdrawn.

Because the compact memory card is small and thin, the binding (engaging) force between slider and the compact memory card cannot be made excessively strong. Furthermore, when abrasion progresses as the memory card is repeatedly inserted and ejected many times, the above-described binding force decreases. In some cases, the inertial force in the direction of ejecting the compact memory card may exceed the binding force. If so, the engagement between the compact memory card and the slider is released when the card is ejected, and the compact memory card springs out from the compact memory card connector and drops down.

Accordingly, there have been proposed compact memory card connectors in which a braking force is applied to the moving slider with the use of friction so as to decelerate the slider. Thus, when the compact memory card is being ejected, it is prevented from disengaging from the slider and springing out from the compact memory card connector.

Patent Document 1: Japanese Laid-Open Patent Application No. 2005-268089

Patent Document 2: Japanese Laid-Open Patent Application No. 2006-140068

However, in the compact memory card connector described in Japanese Laid-Open Patent Application No. 2005-268089, the braking force applied to the slider is strong at first but weak toward the end. Therefore, the slider cannot be sufficiently decelerated at the final stage of sliding, and the memory card cannot be reliably prevented from springing out.

Furthermore, in the compact memory card connector described in Japanese Laid-Open Patent Application No. 2006-140068, a roller is incorporated in the slider. The roller rolls along a tilted surface provided on the inside of the side surface of the connector body. Accordingly, it is difficult to apply a braking force to the slider. Therefore, the slider cannot be sufficiently decelerated at the final stage of sliding, and the memory card cannot be thoroughly prevented from springing out. Moreover, the built-in roller is a separate component from the slider, which makes it difficult to fabricate this type of connector.

SUMMARY OF THE INVENTION

The present invention provides a card connector in which one or more of the above-described disadvantages are eliminated.

An embodiment of the present invention provides a card connector including a housing main unit comprising a card insertion slot through which a card is inserted into the housing main unit in a predetermined direction; a slider attached to the housing main unit in such a manner as to be slidable along the predetermined direction, wherein the card inserted into the housing main unit is ejected by moving together with the slider as a spring force moves the slider from a position away from the card insertion slot toward the card insertion slot; and a slider braking unit configured to apply a braking force to the slider in such a manner that the braking force increases as the slider moves toward the card insertion slot.

According to one embodiment of the present invention, a braking force applied to a slider by a slider braking unit is not of a constant level but increases as the slider moves. Therefore, the speed of the slider can be sufficiently decreased by the time the slider reaches a final position. Accordingly, when the slider reaches the final position and stops, the inertial force applied to a card can be reduced so that the inertial force does not exceed a binding force engaging the card with the slider. Consequently, it is possible to prevent the card from springing outside through the card insertion slot.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

Figure 1:
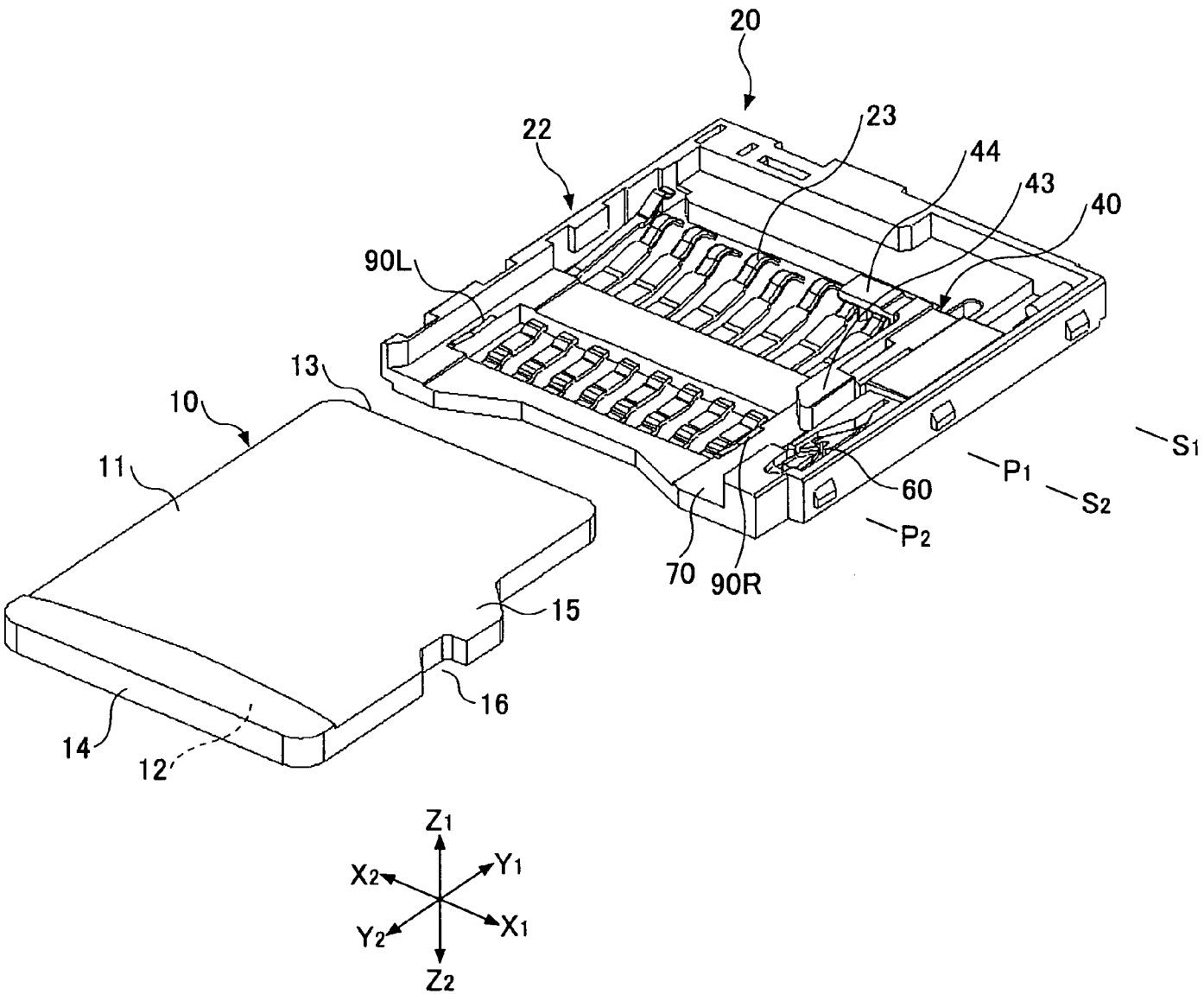
FIG. 1 is a perspective view of a card connector according to an embodiment of the present invention without a cover and a card.
Figure 2:
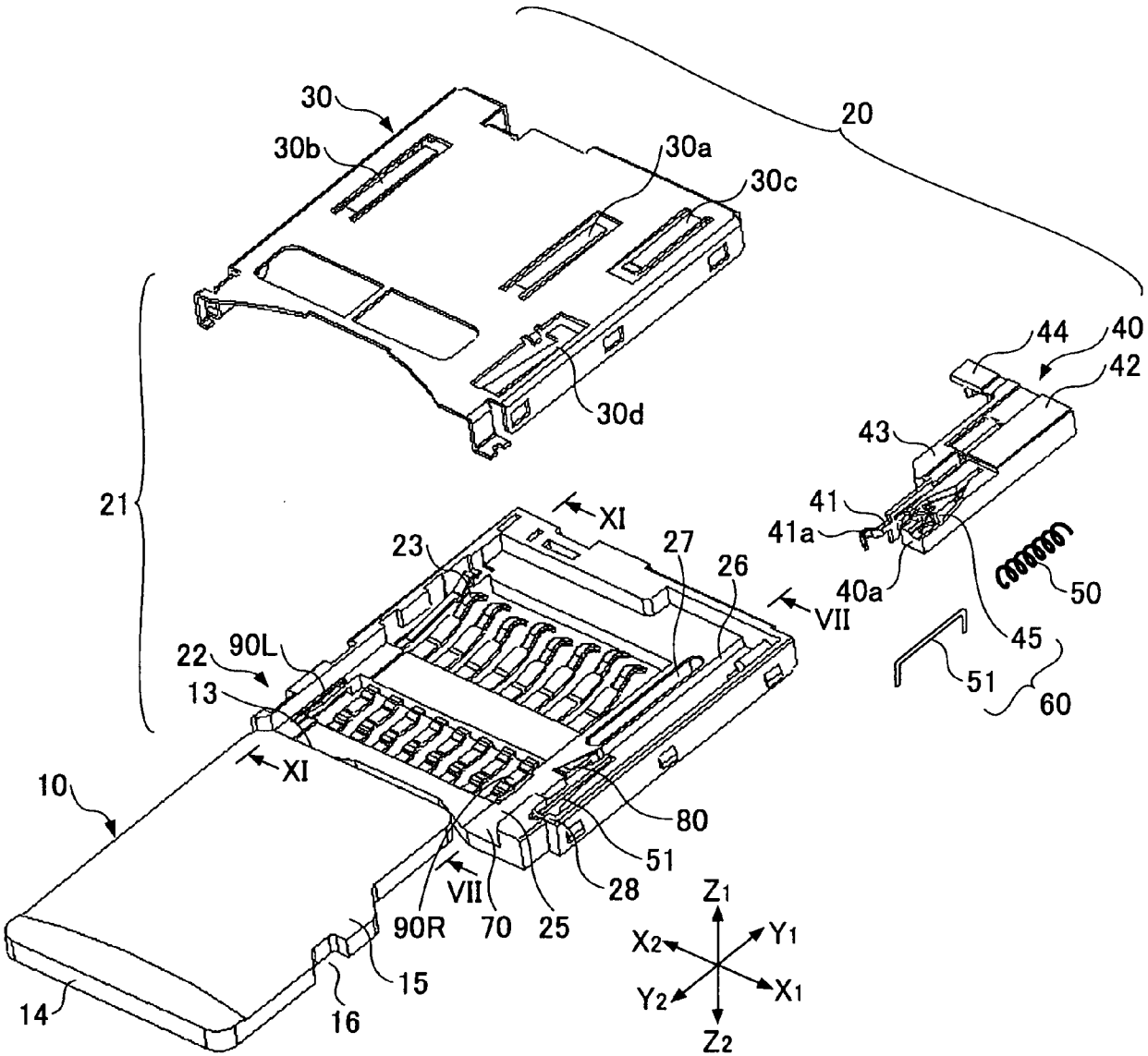
FIG. 2 is an exploded perspective view of the card connector shown in FIG. 1 with the card.

FIG. 1 is a perspective view of a card connector 20 according to an embodiment of the present invention and a micro SD card 10 (registered trademark, hereinafter "card"). The card connector 20 is shown without its cover and is used for inserting the card 10. FIG. 2 is an exploded perspective view of the card connector 20. In the figures, X1-X2 indicates the width direction, Y1-Y2 indicates the length direction, and Z1-Z2 indicates the thickness (height) direction. The card 10 is inserted in the Y1 direction and ejected in the Y2 direction. The Y1 edge of the card 10 is its front edge and the Y2 edge is its rear edge.

The card 10 has a top face 11, a bottom face 12, a front edge 13, and a rear edge 14. An IC memory is provided inside the card 10. There are pads (not shown) arranged on the bottom face 12 near the front edge 13. On the X1 edge, there is a protruding portion 15 and a recessed portion 16.

The card connector 20 includes a connector housing 21, a slider 40, a compression coil spring 50, a heart cam mechanism 60, and a card insertion slot 70 on the Y2 edge.

The connector housing 21 includes a housing body 22 and a cover 30. The housing body 22 is made of synthetic resin and plural contacts 23 are fixed thereon in an aligned manner. The cover 30 covers the top face of the housing body 22.

The cover 30 is made of metal sheets and is fixed to the housing body 22 to cover the housing body 22. The cover 30 has a pair of leaf springs 30*a*, 30*b* for pressing the top face 11 of the inserted card 10, a leaf spring 30*c* for pressing the slider 40, and a leaf spring 30*d* for pressing a link member 51 to be described below.

The slider 40 includes a slider body 42 that is made of synthetic resin, which slider body 42 is substantially L-shaped, and a leaf spring member 41 fixed to this slider body 42. The slider body 42 includes a projecting portion 43 projecting in the X2 direction, an arm portion 44 protruding in the X2 direction from the Y1 edge, and a heart cam groove 45 formed on the top face near the Y2 edge. On the front edge of the leaf spring member 41, there is an engagement portion 41*a* with spring properties protruding in a U-shape in the X2 direction. The projecting portion 43 is formed so as to face the protruding portion 15 and the engagement portion 41*a* is formed so as to engage with the recessed portion 16.

Figure 9A:
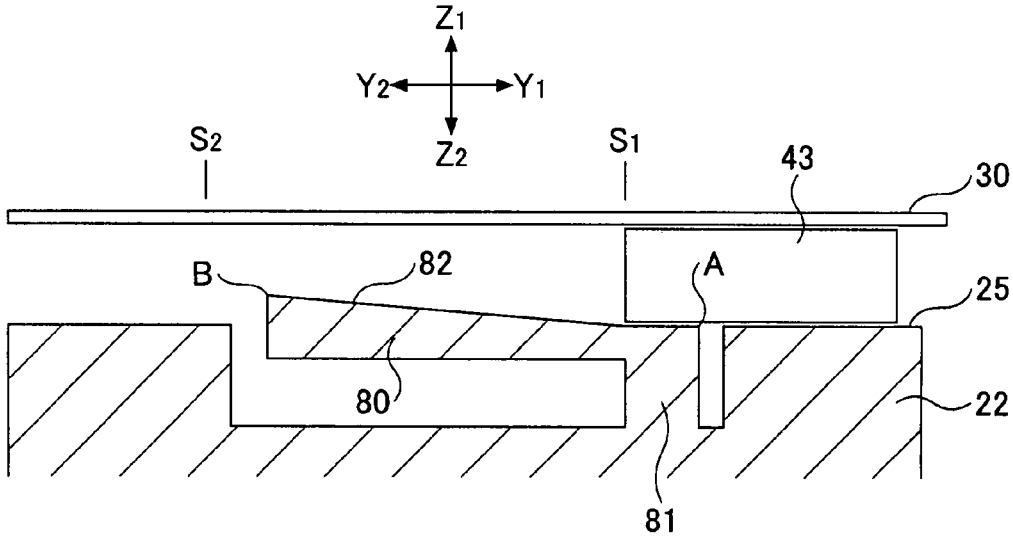
FIGS. 9A-9C illustrate an operation of the brake shoe unit applying a braking force to a slider.

The slider 40 is built into the X1 edge of the housing body 22, inside a space between a top face 25 of the housing body 22 and the bottom face of the cover 30, so as to be slidable in Y1 and Y2 directions along a guide groove 26 (see FIG. 9A). An edge face 40*a* on the Y2 side of the slider 40 is movable between a position P2 and a position P1. The position P2 on the Y2 side is the final position of the slider 40 when sliding in the Y2 direction, and is also the position at which the edge face 40*a* abuts a starting face 28 of the housing body 22. The projecting portion 43 moves between a position S2 and a position S1.

The slider 40 is built in together with the compression coil spring 50 and the link member 51. The compression coil spring 50 is built into a groove 27. The slider 40 is moved in the Y2 direction to the position P2 by the compression coil spring 50. The Y2 edge of the link member 51 is engaged with the housing body 22 and the Y1 edge of the link member 51 is engaged with the heart cam groove 45. The heart cam groove 45 and the link member 51 are included in the heart cam mechanism 60.

The card 10 is inserted as described below. The position of the card 10 is represented by the position of the rear edge 14 of the card 10. FIGS. 3A-3C and 4A-4C illustrate an operation of inserting the card 10. FIGS. 4A, 4B, and 4C correspond to FIGS. 3A, 3B, and 3C, respectively.

In order to insert the card 10, a user inserts the card 10 through the card insertion slot 70 and pushes the rear edge 14 to the final position with his fingertips.

Figure 3A:
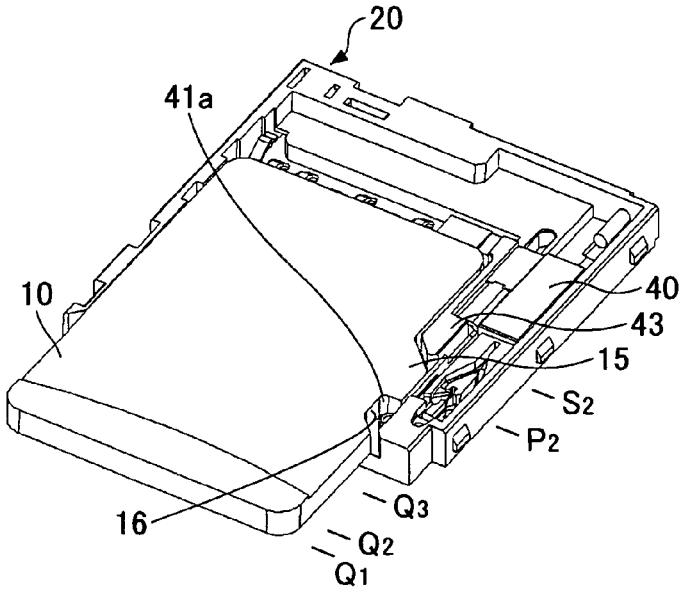
FIGS. 3A-3C illustrate an operation of inserting the card.
Figure 4A:
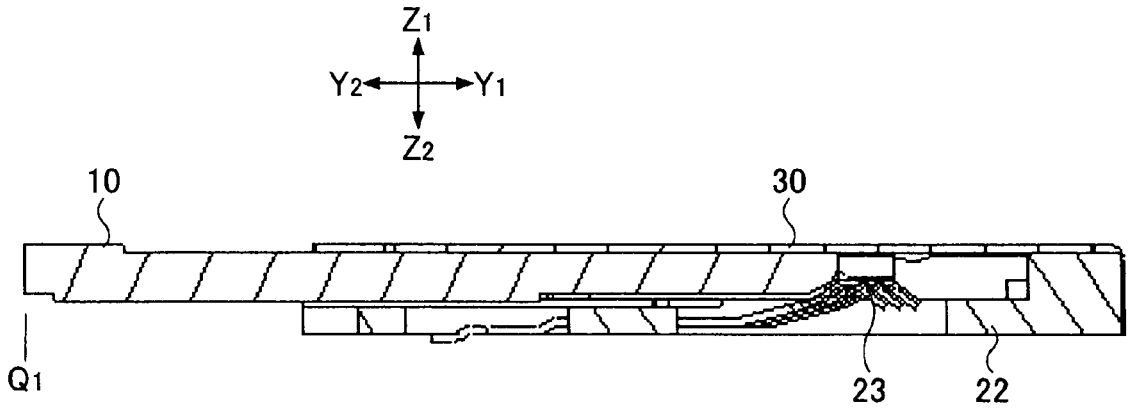
FIGS. 4A-4C correspond to FIGS. 3A-3C, respectively.
Figure 4B:
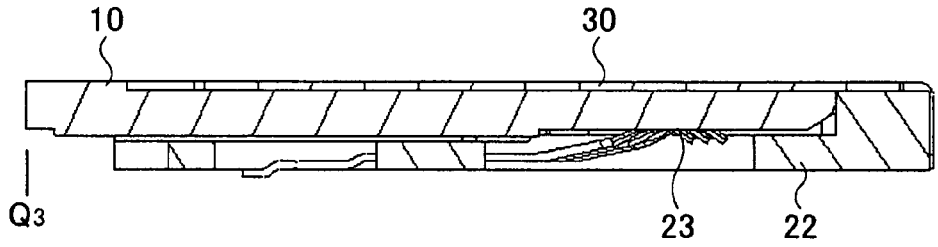
Figure 4C:
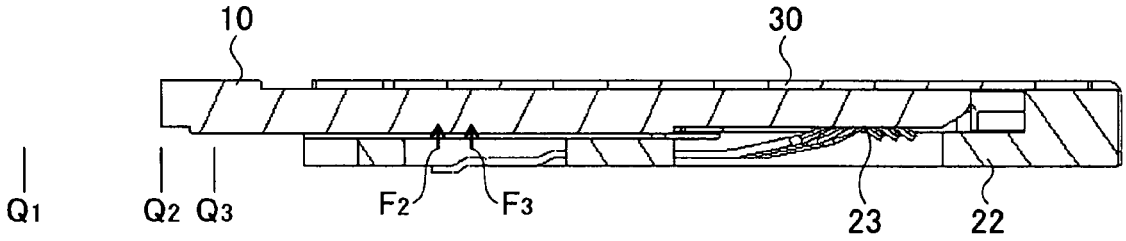

As shown in FIGS. 3A and 4A, when the card 10 inserted through the card insertion slot 70 reaches a position Q1, where the front edge 13 abuts the arm portion 44 and the protruding portion 15 is in contact with the projecting portion 43, the engagement portion 41*a* engages with the recessed portion 16.

Figure 3B:
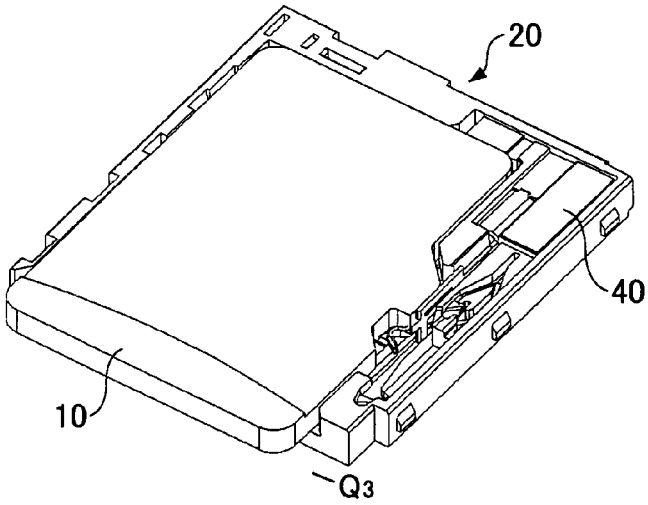
Figure 3C:
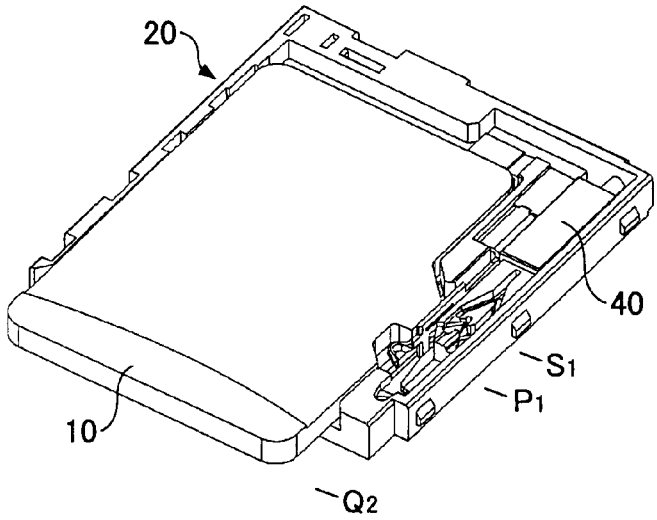

Next, as shown in FIGS. 3B and 4B, the user pushes the card 10 to a final position Q3 with his fingertips. The slider 40 is pushed by the card 10 in the Y1 direction while compressing the compression coil spring 50. When the user finally releases his fingers from the card 10, the slider 40 is moved in the Y2 direction by the compression coil spring 50 and stops at the position P1 (S1) where it is locked by the heart cam mechanism 60, so that the card 10 remains inserted. FIGS. 3C and 4C illustrate a status where the card 10 is inserted (set). The pads are contacting the contacts 23.

In order to eject the card 10, the user temporarily pushes in the card 10 with his fingertips. FIGS. 5A, 5B and 6A, 6B illustrate an operation of ejecting the card 10. FIGS. 6A and 6B correspond to FIGS. 5A and 5B, respectively.

Figure 5A:
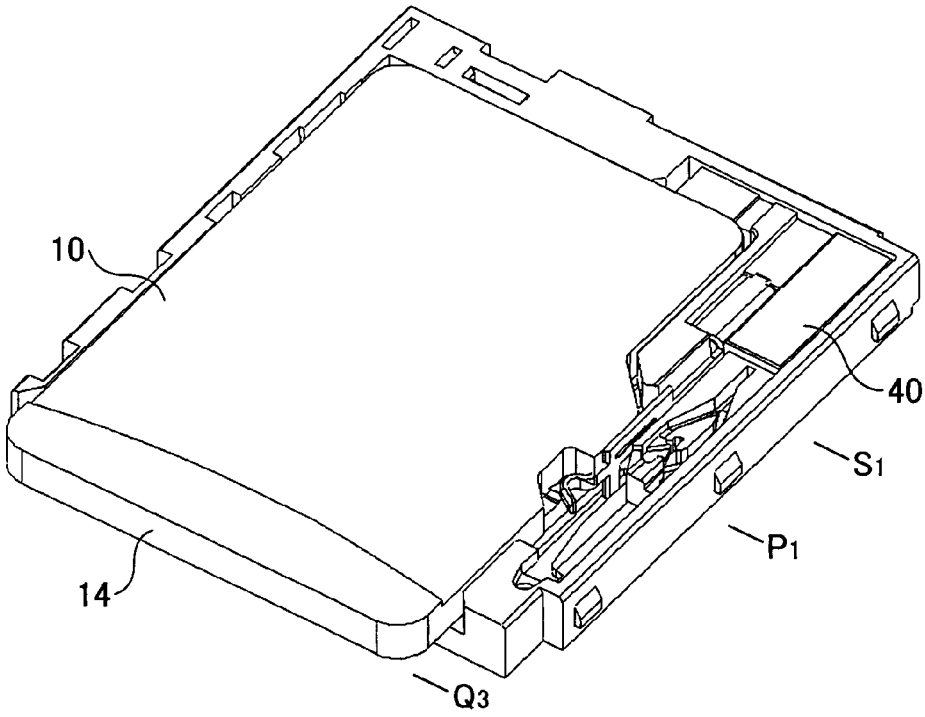
FIGS. 5A, 5B illustrate an operation of ejecting the card.
Figure 5B:
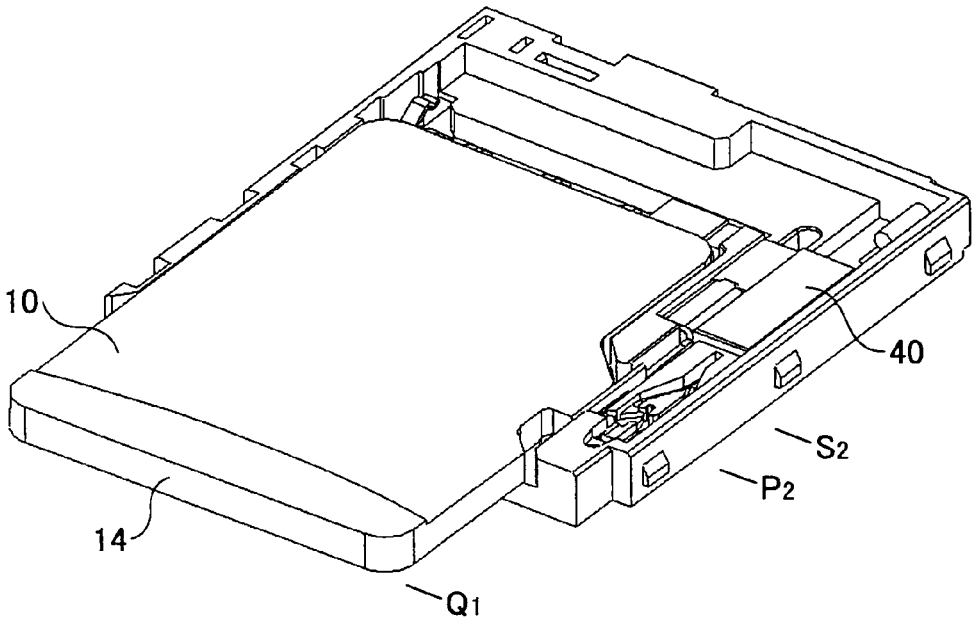
Figure 6A:
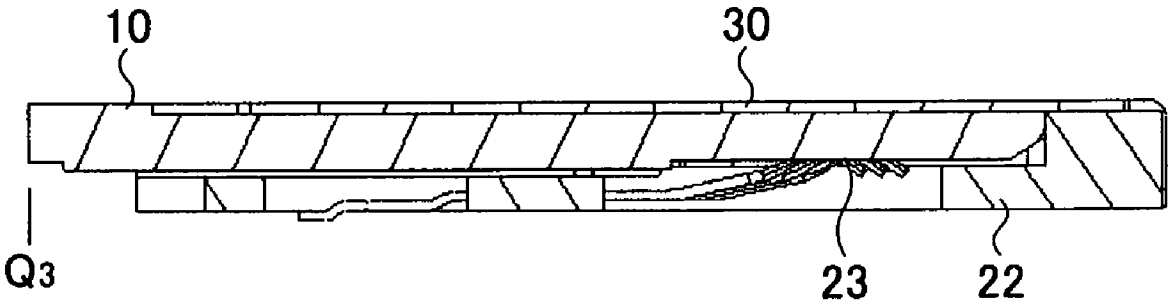
FIGS. 6A, 6B correspond to FIGS. 5A, 5B.
Figure 6B:
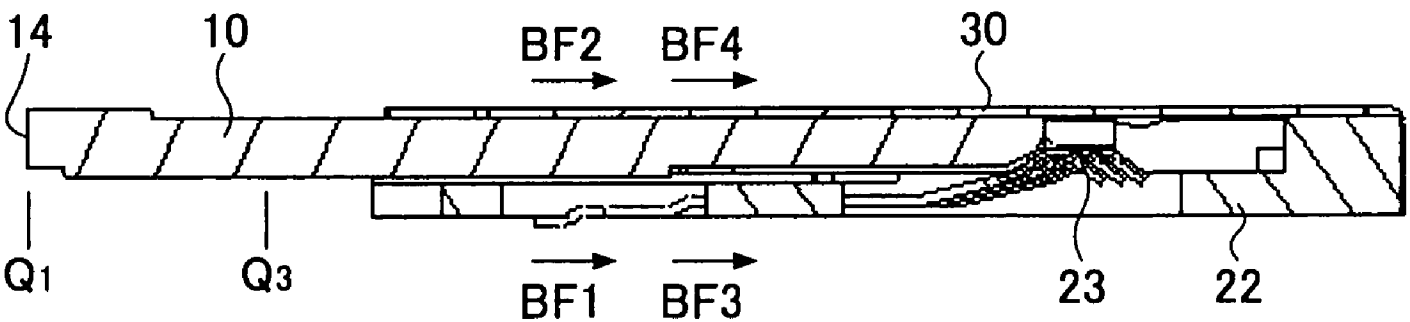

When the user pushes in the card 10 with his fingertips, the slider 40 is pushed by the card 10 in the Y1 direction, to the position shown in FIGS. 5A and 6A. The card 10 is released from being locked by the heart cam mechanism 60 in this status. As the user moves his fingertips back in the Y2 direction, the slider 40 is moved by the spring force of the compression coil spring 50 from the far back position on the Y1 side, which is far away from the card insertion slot 70, toward the card insertion slot 70. The card 10 is pushed by the arm portion 44 of the slider 40 and the projecting portion 43 of the slider 40 that is in contact with the protruding portion 15 of the card 10, so as to move in the Y2 direction together with the slider 40. The slider 40 moves to the position P2 (S2) where the edge face 40*a* abuts the starting face 28 of the housing body 22 and the card 10 is moved back to the position Q1.

Subsequently, the user pinches the card 10 near the rear edge 14 with his fingertips and pulls it out. As a result, the engagement portion 41*a* of the leaf spring member 41 is forcibly bent so that the elastic engagement between the engagement portion 41*a* and the recessed portion 16 is released, and the card 10 is withdrawn.

When the card 10 is being ejected, a careless user may suddenly release his fingers after pressing them against the card 10, which may cause the card 10 to spring outside. The following describes a structure and an operation of a mechanism for preventing the card 10 from springing out of the card connector 20 in such an irregular case.

[Structure and Operation of Brake Shoe Unit 80]

First, a brake shoe unit 80 functioning as a slider braking unit is described.

Figure 7:
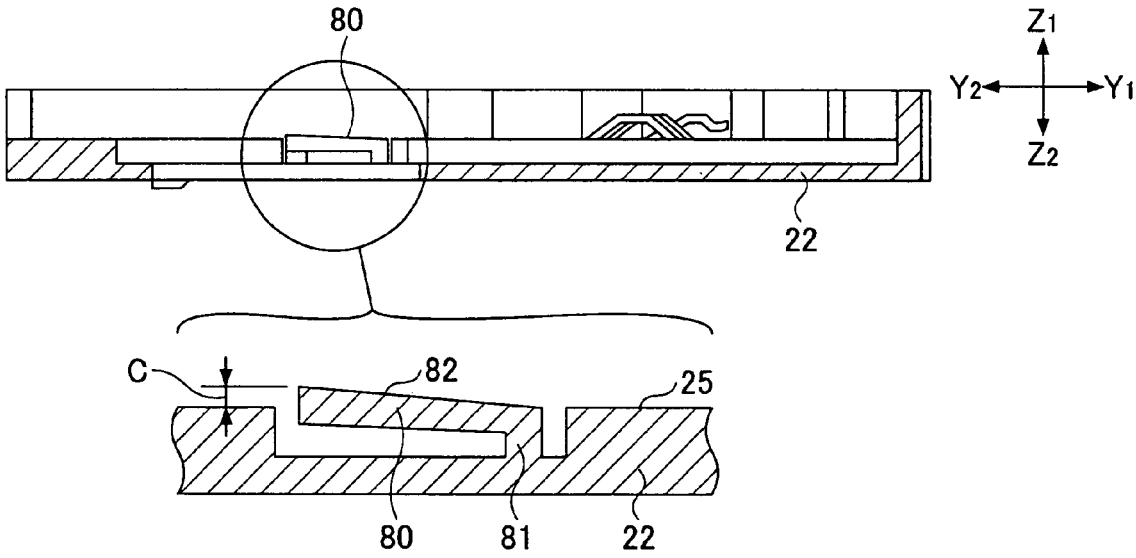
FIG. 7 is an enlarged cross-sectional view taken along line VII-VII passing through a brake shoe unit in FIG. 2.
Figure 8:
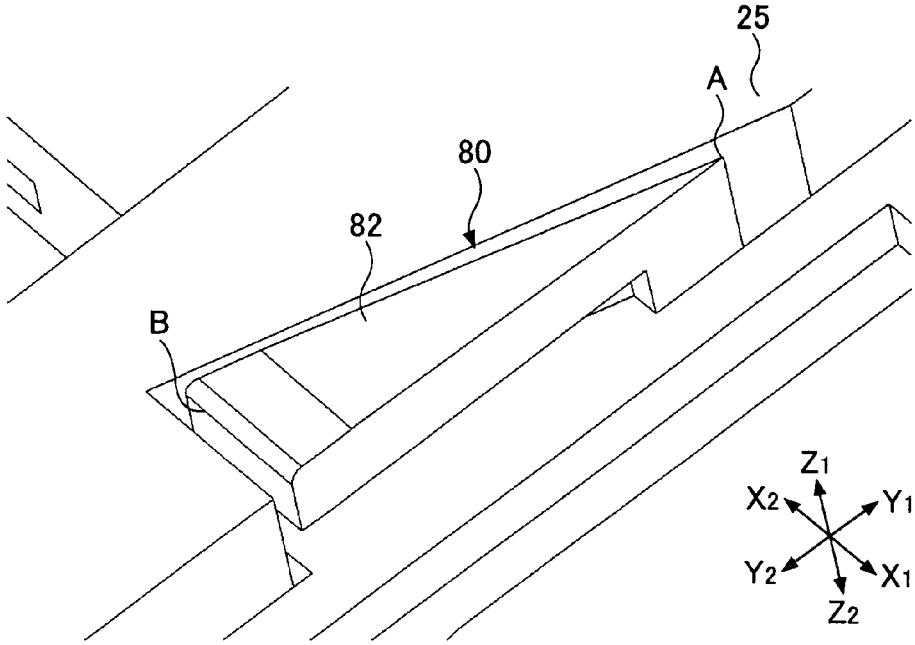
FIG. 8 is an enlarged perspective view of the brake shoe unit.

The brake shoe unit 80 protrudes above the top face 25 of the housing body 22 made of synthetic resin and is arranged on the Y2 side of a path along which the projecting portion 43 of the slider 40 moves. FIG. 7 is an enlarged cross-sectional view taken along line VII-VII passing through the brake shoe unit 80 in FIG. 2, and FIG. 8 is an enlarged perspective view of the brake shoe unit 80.

The Y1 side of the brake shoe unit 80, which is toward the back of the card connector 20, is fixed to the housing body 22 with a connecting part 81. The brake shoe unit 80 has a cantilever structure extending in the Y2 direction from the connecting part 81, and the Y2 edge is elastically deformable in the Z2 direction.

Viewing the brake shoe unit 80 from the top, a top face 82 of the brake shoe unit 80 is a triangular shape extending lengthwise in the Y1-Y2 direction, with an apex A at the connecting part 81 of the brake shoe unit 80 and a base B at the edge on the Y2 side. Furthermore, the top face 82 is tilted in such a manner that the height of the brake shoe unit 80 at the apex A is the same as the top face 25 of the housing body 22 while the base B is higher than the top face 25 of the housing body 22 by a size C in the Z1 direction. The brake shoe unit 80 is formed on the top face 25 of the housing body 22, and therefore, there is no need to increase the width of the card connector 20 in order to form the brake shoe unit 80.

When the card 10 is being ejected, the brake shoe unit 80 has an effect on the projecting portion 43 of the slider 40 as described below.

Figure 9B:
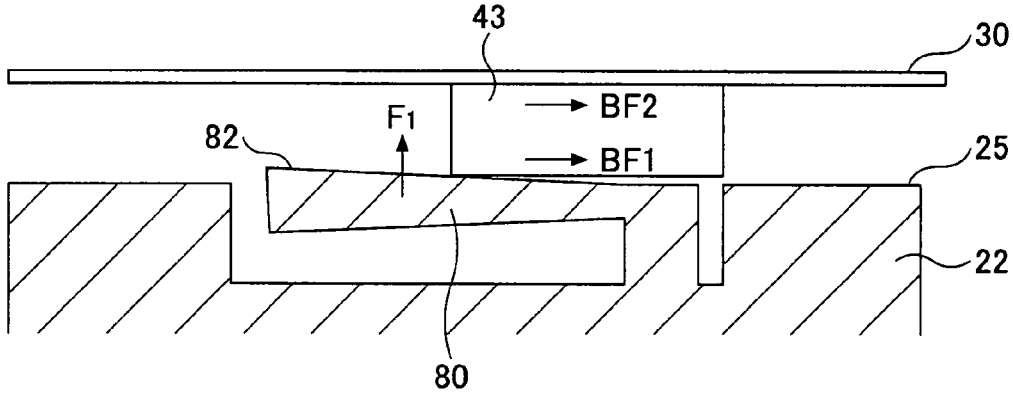
Figure 9C:
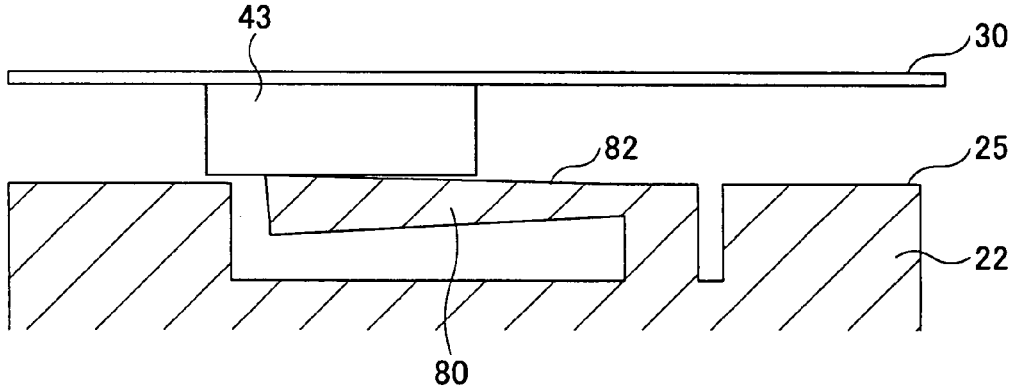

FIGS. 9A-9C illustrate an operation of the brake shoe unit 80 applying a braking force to the slider 40. FIG. 9A illustrates the status when the card ejecting operation is about to start. The Y2 edge of the projecting portion 43 of the slider 40 is at the position S1, which is above the connecting part 81 of the brake shoe unit 80. There is no braking force applied to the slider 40 at this point. When the slider 40 is released from being locked by the heart cam mechanism 60, the slider 40 is caused to start moving by the spring force of the compression coil spring 50 toward the Y2 direction from a position far away from the card insertion slot 70. The projecting portion 43 of the slider 40 moves onto the brake shoe unit 80 as shown in FIG. 9B, thereby elastically displacing (pushing down) the base B of the brake shoe unit 80 in the Z2 direction, and then moves to the final position S2 as shown in FIG. 9C. Finally, the slider 40 instantaneously stops moving as soon as the edge face 40*a* of the slider 40 abuts the starting face 28 of the housing body 22.

The brake shoe unit 80 is elastically bent downward, which generates an elastic recoil pressure F1 in the Z1 direction. The elastic recoil pressure F1 causes the brake shoe unit 80 to be pressed against the projecting portion 43 and thus generates a frictional force. The elastic recoil pressure F1 also causes the top face of the slider body 42 to be pressed against the bottom face of the cover 30 and thus generates a frictional force. These frictional forces provide braking forces BF1 and BF2 to the slider 40 (see FIG. 6B).

Figure 10:
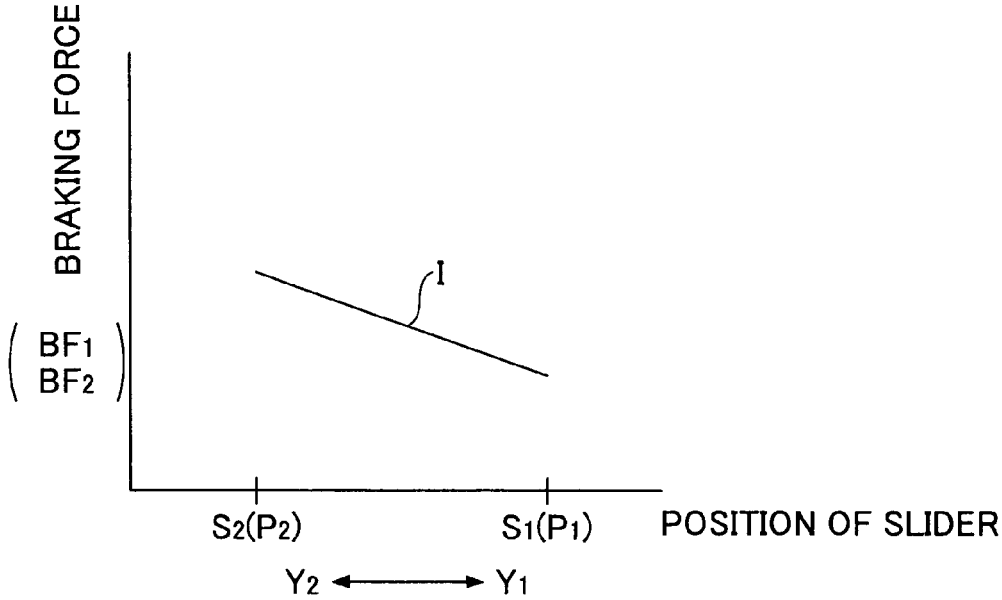
FIG. 10 is a graph indicating the relationship between the braking force applied to the slider by the brake shoe unit and the position of the slider.

The top face 82 of the brake shoe unit 80 is a triangular shape with its Y1 edge being the apex A and its Y2 edge being the base B. Accordingly, as the slider 40 moves in the Y2 direction, the contact area between the bottom face of the projecting portion 43 and the top face 82 of the brake shoe unit 80 increases rapidly. Therefore, the frictional force applied from the projecting portion 43 to the brake shoe unit 80 increases as the slider 40 moves in the Y2 direction. Thus, as the slider 40 moves in the Y2 direction, the braking forces BF1 and BF2 applied to the slider 40 increase, as indicated by a line I shown in the graph of FIG. 10. That is, the braking forces BF1 and BF2 applied to the slider 40 become stronger as the slider 40 moves in the Y2 direction.

If the braking forces BF1 and BF2 are at levels that make the slider 40 move slowly and are fixed at constant levels regardless of the position of the slider 40, the following problems are conceivable. That is, in an irregular case where a user suddenly releases his fingers after pressing them against the card 10, the slider 40 is pushed by the compression coil spring 50. The slider 40 accelerates as it moves further, so that the slider 40 and the card 10 are moving fast immediately before they are supposed to be stopped instantaneously. Accordingly, a large inertial force is applied to the card 10 in the Y2 direction at the time when the slider 40 and the card 10 are supposed to be instantaneously stopped. This large inertial force may cause the recessed portion 16 to disengage from the engagement portion 41*a*. However, according to the present embodiment, the slider 40 receives a stronger braking force B1 as it moves in the Y2 direction. Therefore, the slider 40 and the card 10 are moving at a lower speed immediately before the edge face 40*a* abuts the starting face 28 of the housing body 22, compared to the case where a constant braking force is applied regardless of the position of the slider 40. Thus, compared to the case where a constant braking force is applied regardless of the position of the slider 40, according to an embodiment of the present embodiment, a smaller inertial force is applied to the card 10 when the slider 40 is caused to instantaneously stop as the edge face 40*a* abuts the starting face 28. As a result, the recessed portion 16 is prevented from disengaging from the engagement portion 41*a* and the card 10 is prevented from springing out of the card connector 20 through the card insertion slot 70.

If the slider 40 is configured to receive a strong braking force from the beginning, when the slider 40 is released from being locked by the heart cam mechanism 60, the slider 40 may not start moving smoothly. However, according to an embodiment of the present invention, substantially no braking force is applied to the slider 40 in the beginning, and therefore, the slider 40 can start moving smoothly.

It is possible to make the brake shoe unit 80 rigid and make the projecting portion 43 of the slider 40 have a spring section, so that this spring section bends upward as the projecting portion 43 moves onto the brake shoe unit 80.

[Structure and operation of card supporting springs (push-up springs) 90R, 90L]

Next, card supporting springs (push-up springs) 90R, 90L functioning as card braking units are described.

As shown in FIG. 2, the housing body 22 made of synthetic resin is provided with the card supporting springs 90R, 90L for supporting the inserted card 10 on the X1 side (right side) and the X2 side (left side) near the card insertion slot 70.

Figure 11:
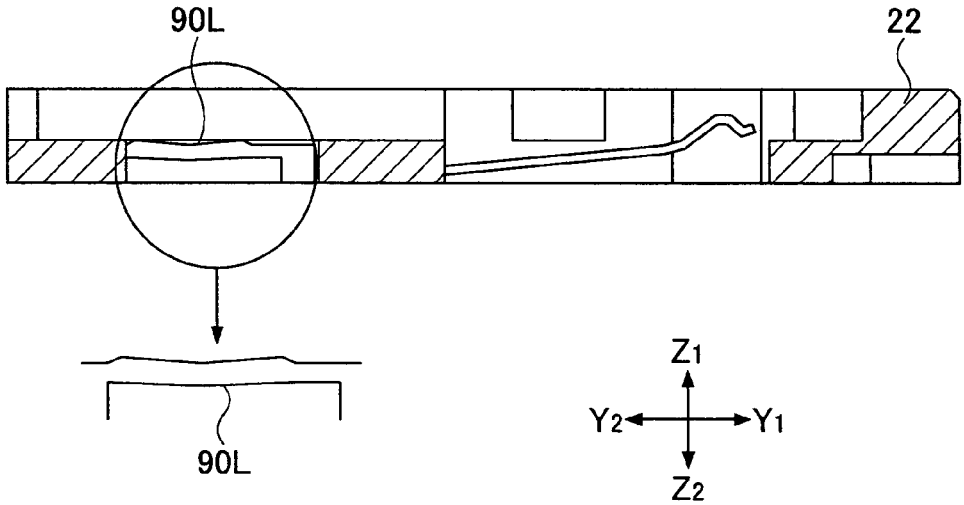
FIG. 11 is an enlarged cross-sectional view taken along line XI-XI passing through a card supporting spring in FIG. 2.
Figure 12:
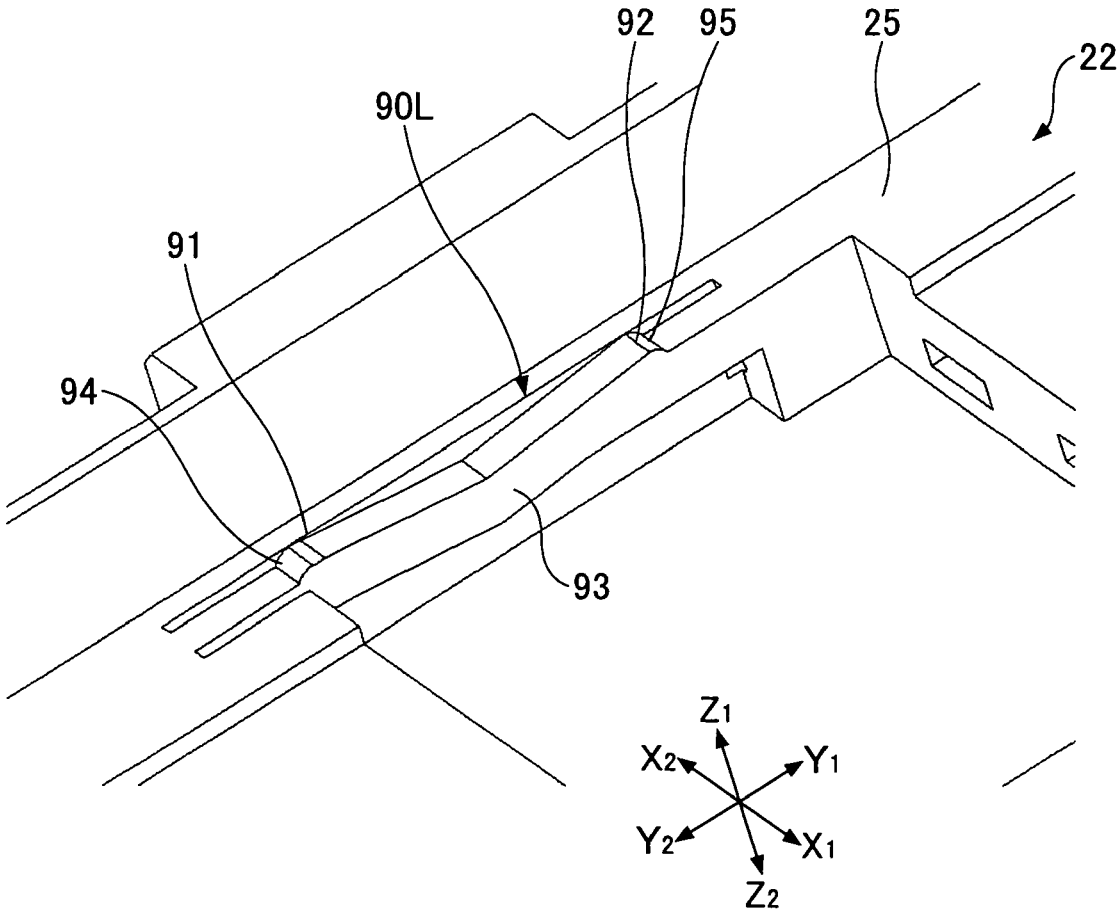
FIG. 12 is an enlarged perspective view of the card supporting spring.

FIG. 11 is an enlarged cross-sectional view taken along line XI-XI passing through the card supporting spring 90L in FIG. 2. FIG. 12 and FIGS. 13A-13C are enlarged views of the card supporting spring 90L. The card supporting spring 90L extends lengthwise in the Y1-Y2 direction, has a beam shape that is fixed at both ends, and protrudes above the top face 25 of the housing body 22 in the Z1 direction.

The card supporting spring 90L has protruding parts 91, 92 on the Y2 side and the Y1 side, respectively, and a recessed part 93 in the center that is recessed in the Z2 direction, thus forming an upside down W shape. The Y2 side of the protruding part 91 includes a slope 94 and the Y1 side of the protruding part 92 includes a slope 95.

A size D of the gap between the protruding parts 91, 92 and the bottom face of the cover 30 is slightly less than the thinnest size within a thickness tolerance range of the card 10.

The card supporting spring 90R has the same configuration as the card supporting spring 90L.

Figure 13A:
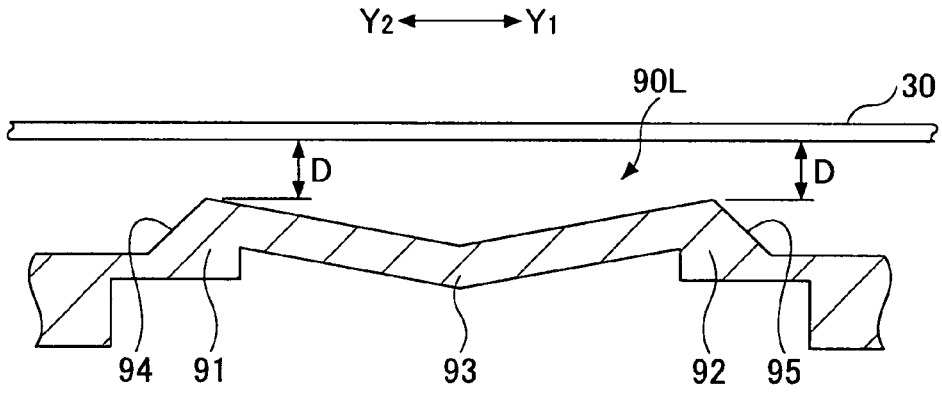
FIGS. 13A-13C illustrate the operations of the card supporting spring.
Figure 13B:
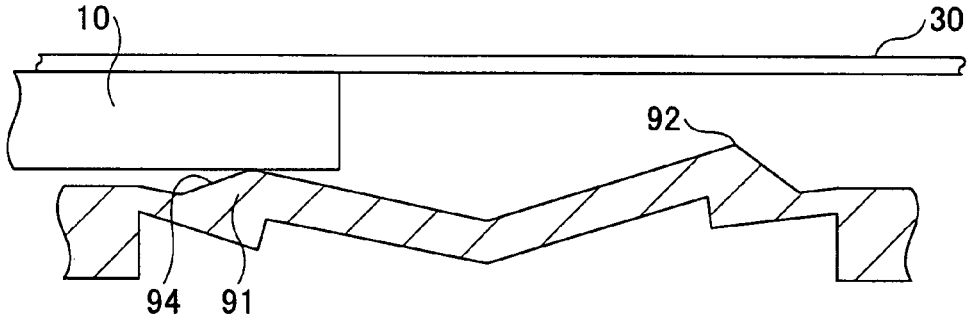

When the card 10 is inserted through the card insertion slot 70, as shown in FIG. 13B, the card 10 is guided by the slope 94 of the card supporting spring 90L (90R) to move onto the protruding part 91. The card 10 displaces (pushes down) the protruding part 91 in the Z2 direction and passes over the protruding part 91. During this movement, the card supporting spring 90L (90R) is elastically bent down, particularly on the Y2 side, as shown in FIG. 13B.

Figure 13C:
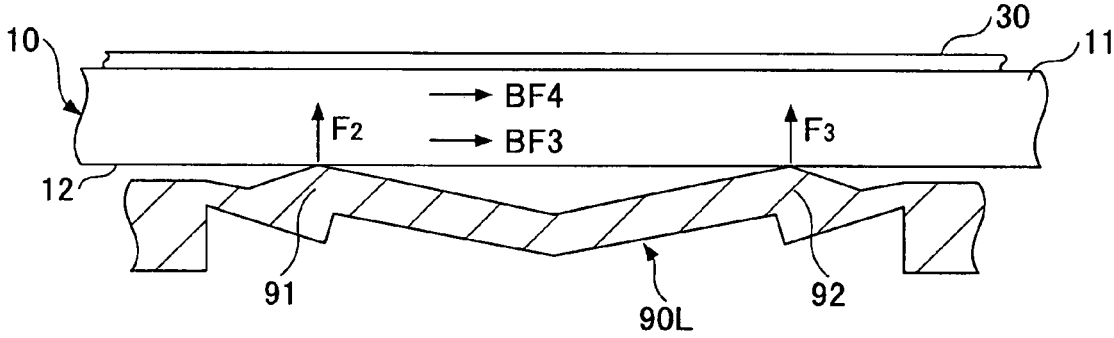

As the card 10 is inserted further inside, as shown in FIG. 13C, the card 10 passes over the protruding part 92, so that the card supporting spring 90L (90R) is bent down.

When the card 10 is completely inserted, the right and left sides of the card 10 near the rear edge 14 are pushed upward in the Z1 direction by forces F2 and F3 generated by the card supporting springs 90R, 90L. Accordingly, the card 10 is pushed against the bottom face of the cover 30.

When the card 10 is ejected, the card 10 moves in the Y2 direction while the bottom face 12 is contacting the card supporting springs 90R, 90L and the top face 11 is contacting the cover 30. The friction that is generated at these contacting portions applies braking forces BF3 and BF 4 to the card 10 moving in the Y2 direction (see FIG. 6B).

The braking forces BF3 and BF 4 also prevent the card 10 from springing out from the card connector 20.

The card supporting springs 90R, 90L also prevent the contacts 23 of the card connector 20 and the pads of the memory card 10 from being instantaneously disconnected (referred to as instantaneous interruption). Mobile phones are used in various circumstances. For example, they are carried by users, operated by being unfolded, and placed over data reading devices. Accordingly, they are used in circumstances where they are susceptible to shocks, i.e., instantaneous interruptions. When an instantaneous interruption occurs, part of data transmitted between the memory card and the main unit of the mobile phone becomes lost, which may cause serious problems. It is thus important to prevent such instantaneous interruptions. An instantaneous interruption occurs when the card connector 20 receives a shock and the card 10 oscillates inside the card connector 20. As a result, the contacts 23 resonate, which causes the instantaneous interruption.

In the embodiment of the present invention, when the card 10 is completely inserted, as shown in FIG. 4C, the plural contacts 23 push up the card 10 in the Z1 direction at the pads (not shown) on the bottom face near the front edge 13. Moreover, the card supporting springs 90R, 90L push up the card 10 in the Z1 direction on the X1 side and the X2 side on the bottom face near the rear edge 14, i.e., the portions away from the pads (not shown). Accordingly, the entire top face 11 of the card 10 is pushed against the bottom face of the cover 30. That is, the card 10 is prevented from moving freely in the Z2 direction not only at the front edge 13 but also at the rear edge 14. The card supporting springs 90R, 90L also absorb the shock received by the card connector 20. Thus, when the card connector 20 receives a shock, the rear edge 14 of the card 10 is prevented from moving in the Z1-Z2 direction inside the card connector 20, centering around the pads (not shown) pressed against the contacts 23. Hence, the card 10 is prevented from oscillating in the card connector 20, so that an instantaneous interruption is prevented.

When the card 10 is inserted, the card 10 first passes over the protruding part 91 and then the protruding part 92. Accordingly, the load on the card 10 while being inserted is distributed, so that the card 10 can be inserted smoothly.

The brake shoe unit 80 and the card supporting springs (push-up springs) 90R, 90L are formed integrally with the housing body 22 (as a single integral unit), and therefore, the card connector 20 does not require special components and is thus easy to be fabricated.

The present invention is not limited to the specifically disclosed embodiment, and variations and modifications may be made without departing from the scope of the present invention.

The invention claimed is:

1. A card connector comprising:

a housing main unit comprising a card insertion slot through which a card is inserted into the housing main unit in a predetermined direction;

a slider attached to the housing main unit in such a manner as to be slidable along the predetermined direction, wherein the card inserted into the housing main unit is ejected by moving together with the slider as a spring force moves the slider from a first position at which the slider is away from the card insertion slot to a second position toward the card insertion slot at which the slider is stopped; and a slider braking unit configured to apply a braking force to the slider in such a manner that the braking force increases as the slider moves from the first position to the second position.

2. The card connector according to claim 1, wherein the slider braking unit comprises a brake shoe unit, wherein:

the brake shoe unit is formed integrally with the housing main unit and protrudes above a top surface of the housing main unit;

the brake shoe unit comprises a top face having a triangular shape viewed from the top, wherein an apex of the triangular shape is on a far side and a base of the triangular shape is on a near side with respect to the card insertion slot; and the top face of the brake shoe unit is tilted in such a manner that the base is higher than the top surface of the housing main unit than is the apex.

3. The card connector according to claim 2, wherein:

the brake shoe unit comprises a fixed end and a free end, wherein the fixed end is near the back of the card connector and is connected to the housing main unit and the free end is near the card insertion slot and is not connected to the housing main unit, thereby forming a cantilever structure.

4. The card connector according to claim 1, further comprising:

a card braking unit configured to apply a braking force to the card while the card is being ejected.

5. The card connector according to claim 4, wherein:

the card braking unit is formed on the housing main unit and protrudes above a top surface of the housing main unit; and the card braking unit comprises one or more push-up springs configured to push up a bottom face of the card inserted into the housing main unit.

6. The card connector according to claim 5, wherein:

a pair of the push-up springs is provided in such a manner as to support a left side and a right side of the bottom face of the card near a rear edge of the card.

7. The card connector according to claim 5, wherein:

the push-up springs are arranged in such a manner that the card braking unit has an upside down W shape fixed at both ends to the housing main unit with two protruding parts in contact with the bottom face of the card.

8. An apparatus comprising:

a housing having a slot through which a card is inserted in a first direction;

a slider attached to the housing and slidable in the first direction, wherein the card is ejected by moving together with the slider from a first position at which the slider is away from the slot to a second position toward the slot at which the slider is stopped; and means for applying a braking force to the slider such that the braking force increases as the slider moves from the first position to the second position.

* * * * *